US009677288B2

(12) United States Patent
Peck

(10) Patent No.: US 9,677,288 B2
(45) Date of Patent: Jun. 13, 2017

(54) CURVILINEAR DROP CEILING LED LIGHTING PANEL

(71) Applicant: Enlighten Luminaires LLC, Weston, FL (US)

(72) Inventor: Andrew Peck, Paramus, NJ (US)

(73) Assignee: ENLIGHTEN LUMINAIRES LLC, Weston, FL (US)

( * ) Notice: Subject to any disclaimer, the term of this patent is extended or adjusted under 35 U.S.C. 154(b) by 234 days.

(21) Appl. No.: 14/618,101

(22) Filed: Feb. 10, 2015

(65) Prior Publication Data

US 2015/0308129 A1 Oct. 29, 2015

Related U.S. Application Data

(60) Provisional application No. 61/983,197, filed on Apr. 23, 2014.

(51) Int. Cl.

| | |
|---|---|
| ***F21S 8/02*** | (2006.01) |
| ***E04F 19/02*** | (2006.01) |
| ***F21V 21/04*** | (2006.01) |
| ***F21V 23/02*** | (2006.01) |
| ***F21V 23/06*** | (2006.01) |

(Continued)

(52) U.S. Cl.

CPC ..... *E04F 19/02* (2013.01); *F21S 4/20* (2016.01); *F21S 8/026* (2013.01); *F21V 21/048* (2013.01); *F21V 23/023* (2013.01); *F21V 23/06* (2013.01); *F21V 15/01* (2013.01); *F21V 17/104* (2013.01); *F21Y 2103/10* (2016.08); *F21Y 2113/00* (2013.01); *F21Y 2115/10* (2016.08)

(58) Field of Classification Search

CPC .... F21S 4/20; F21S 6/006; F21S 6/007; F21S 6/08; F21S 8/026; F21S 8/04; F21S 8/06; F21V 15/01; F21V 15/013; F21V 15/015; F21V 21/02; F21V 21/04; F21V 21/041; F21V 21/044; F21V 21/048; F21V 7/0008

See application file for complete search history.

(56) References Cited

U.S. PATENT DOCUMENTS

| | | | |
|---|---|---|---|
| 4,490,957 | A | 1/1985 | Bumpus et al. |
| 5,162,696 | A | 11/1992 | Goodrich |

(Continued)

FOREIGN PATENT DOCUMENTS

| | | |
|---|---|---|
| WO | WO 99/39131 | 8/1999 |
| WO | WO 2013/021311 | 2/2013 |

*Primary Examiner* — Renee Chavez
*Assistant Examiner* — Zheng Song
(74) *Attorney, Agent, or Firm* — Michael J. Feigin, Esq.; Feigin & Fridman

(57) ABSTRACT

Embodiments of the disclosed technology are directed to a light fixture and a method of assembly thereof. The light fixture is generally formed of two opposing side rails joined to two opposing caps. The fixture has two panels: an upper panel and a lower panel. The upper panel is formed of a generally flat, deflectable elongated section having a plurality of lights disposed on or in a surface thereof. The upper panel is deflected to form a substantially curvilinear panel, the edges of which are engaged into a slot on the side rails and/or the end caps. The lower panel is also generally flat and formed of a transparent or translucent material. The lower panel is disposed below the upper panel, such that the light projected from the lights on the upper panel projects through the lower panel.

6 Claims, 10 Drawing Sheets

(51) Int. Cl.

| | |
|---|---|
| ***F21S 4/20*** | (2016.01) |
| *F21V 15/01* | (2006.01) |
| *F21V 17/10* | (2006.01) |
| *F21Y 115/10* | (2016.01) |
| *F21Y 113/00* | (2016.01) |
| *F21Y 103/10* | (2016.01) |

(56) References Cited

U.S. PATENT DOCUMENTS

| | | | | |
|---|---|---|---|---|
| 5,584,547 | A * | 12/1996 | Trulaske, Sr. | A47F 3/0434 312/114 |
| 5,823,663 | A * | 10/1998 | Bell | F21S 8/02 362/260 |
| 6,210,025 | B1 * | 4/2001 | Schmidt | F21S 8/026 362/217.12 |
| 7,815,355 | B2 | 10/2010 | Thompson et al. | |
| 8,115,393 | B2 | 2/2012 | Neal et al. | |
| 8,118,450 | B2 | 2/2012 | Villard | |
| 8,319,433 | B2 | 11/2012 | Lin et al. | |
| 8,408,751 | B2 | 4/2013 | Chen | |
| 8,454,214 | B2 | 6/2013 | Kazaoka | |
| 8,585,248 | B1 * | 11/2013 | Isaacson | F21V 29/004 362/294 |
| 2003/0117798 | A1 | 6/2003 | Leysath | |
| 2008/0037239 | A1 | 2/2008 | Thomas et al. | |
| 2009/0034263 | A1 * | 2/2009 | Stenback | F21V 15/01 362/296.01 |
| 2010/0102729 | A1 | 4/2010 | Katzir et al. | |
| 2010/0182782 | A1 * | 7/2010 | Ladewig | F21V 7/0008 362/235 |
| 2011/0199767 | A1 | 8/2011 | Marquardt et al. | |
| 2011/0310604 | A1 * | 12/2011 | Shimizu | F21V 3/0445 362/235 |
| 2012/0186120 | A1 * | 7/2012 | Suciu | G09F 15/0037 40/606.12 |
| 2012/0217882 | A1 | 8/2012 | Wong et al. | |
| 2012/0300471 | A1 * | 11/2012 | Howe | F21V 3/0445 362/328 |
| 2013/0070455 | A1 | 3/2013 | Tsui et al. | |
| 2013/0107530 | A1 | 5/2013 | Wyrick et al. | |
| 2013/0294053 | A1 * | 11/2013 | Marquardt | F21V 33/006 362/145 |
| 2014/0016313 | A1 | 1/2014 | Adams | |

* cited by examiner

CURVILINEAR DROP CEILING LED LIGHTING PANEL

FIELD OF THE DISCLOSED TECHNOLOGY

The disclosed technology relates generally to lighting fixtures, and, more specifically, a curvilinear LED lighting fixture.

BACKGROUND OF THE DISCLOSED TECHNOLOGY

Drop ceiling lighting fixtures typically use elongated, expensive fluorescent bulbs. The bulbs are difficult to install and susceptible to burn-out and/or breaking. Light emitting Diodes ("LED") are an increasingly used mode of lighting. The LEDs consume less electricity and burn for a much longer duration than typical light bulbs. A light emitting diode typically is formed of a two-lead semiconductor light source.

Many light fixtures and assemblies available for purchase are bulky and require assembly, using a multitude of tools. Moreover, these light fixtures are often large, heavy, and quite expensive. Thus, a great deal of extra hardware may be required in order to properly hang these heavy structures. Replacement of fluorescent tube bulbs for such fixtures is also difficult and costly.

Thus, there is a need unfulfilled in the art for a lightweight, inexpensive, transportable, power-saving light fixture that is easy to assemble without compromising on light coverage.

SUMMARY OF THE DISCLOSED TECHNOLOGY

Embodiments of the disclosed technology are directed to a lighting fixture and a method of assembly thereof. The light fixture is generally formed of two opposing side rails joined to two opposing caps. The fixture has two panels; an upper panel and a lower panel. The upper panel is formed of a generally flat, deflectable elongated section. The upper panel has a plurality of lights disposed on or in a surface thereof. The lights may be arranged in a particular pattern or grid, in order to provide the greatest light coverage. When assembling the light fixture, the upper panel is deflected to form a substantially curvilinear panel, the edges of which are engaged into a slot on the side rails and/or the end caps. The lower panel is also generally flat and formed of a transparent or translucent material. The lower panel as well is engaged to the side rails and end caps, but retains its original flat shape. The lower panel is disposed below the upper panel, such that the light projected from the lights on the upper panel projects through the lower panel.

In an embodiment of the disclosed technology, a light fixture is formed of a substantially flat planar panel, a substantially flat planar and translucent lower panel, two opposing end caps, and two opposing side rails. The substantially flat planar panel has two long edges and two short edges, and is deformed into a curvilinear upper panel by way of two opposing side rails held in place by two opposing end caps. Each of the two opposing end caps has two flanges which are disposed at an end of each respective end cap, in a manner such that the flanges extend or emanate orthogonally from an elongated length of the end cap in a single direction.

The two opposing side rails may have a first elongated length with three distinct slots extending therefrom. One of the slots corresponds to, and engages with, at least one edge of the lower panel. Another slot may be angular, and may frictionally engage at least one edge of the curvilinear panel. Still another slot disposed in the side rail may engage the flanges extending orthogonally from the end cap. The light fixture may have a plurality of LED lights disposed on an inner surface thereof. Each of the end caps may also have supports which abut the curvilinear panel In another embodiment of the disclosed technology, a light fixture has a a curvilinear upper panel, a lower panel, two opposing end caps, and two opposing side rails. The upper panel, in a resting state, is flat, rectangular and deflectable, having two long edges and two short edges. "Deflectable," for purposes of this specification, is defined as "capable of being bent by the hands of an average ten year-old boy without the aid of tools, while returning substantially to the pre-bent shape after a bending force is removed." "Substantially" is defined as "at least 90% or what is considered to be so by a person having ordinary skill in the art." The lower panel is substantially flat, rectangular and translucent, having two long edges and two short edges. The two opposing side rails frictionally engage the upper panel and hold the upper panel in a curvilinear state and the lower panel in the substantially flat state, the two opposing side rails further held in place by the two opposing end caps.

In a further embodiment, the light fixture may have a plurality of LEDs disposed on a surface of the curvilinear upper panel. Still further, each of the two opposing side rails has a horizontal bottom slot with an edge of the lower panel engaged therein. Each of the two opposing side rails may also have an orthogonal vertical slot with flanges from the end caps engaged therein. Furthermore, each of the two opposing side rails may have a curvilinear upper slot with an edge of the curvilinear upper panel engaged therein.

In still another embodiment of the disclosed technology, a method is used for assembling a light fixture. The method may be carried out, not necessarily in the following order, by: a) arranging two opposing side rails parallel to one another; b) inserting a flat longitudinal panel between the two opposing side rails; c) inserting a second flat longitudinal panel between the two opposing side rails, wherein the second longitudinal panel has a length substantially equal to the first longitudinal panel and a longer width than the first longitudinal panel; and/or d) connecting an end cap to each of the opposing side rails, such that the first flat longitudinal panel remains flat between the side rails and the second flat longitudinal panel becomes curved with a concave side thereof facing towards the first longitudinal panel.

In a further embodiment, an additional step to the method may be provided by attaching a power source to LED strips on the concave side of the first longitudinal panel. Still another step may consist or comprise of inserting longer edges of a rectangular, translucent lower panel into the horizontal bottom slots, such that each side rail covers substantially or fully an entire length of each longer edge of the lower panel. In still another embodiment, a step may be provided of deflecting a rectangular, upper panel to an angle of curvature between 90 degrees and 180 degrees, and inserting longer edges of the upper panel into the curvilinear upper slots of the side rails, such that the upper panel becomes fixed in a deflected position.

DETAILED DESCRIPTION OF EMBODIMENTS OF THE DISCLOSED TECHNOLOGY

The presently disclosed technology is a device and method for constructing a drop ceiling LED light fixture having a curved upper panel. The panel has a plurality of rows or strips of LED bulbs. The upper panel is generally flat and flexible (such that it may be stored and packaged in a flattened state). The upper panel, in a method of assembly of the light fixture, is bent between two side rails and fixed in place by an end cap. Further, a translucent or transparent sheet is held between the side rails and end caps in the assembled form. Once installed, the panel may form a curvilinear light emitting panel surface.

Embodiments of the disclosed technology will become clearer in view of the description of the following figures.

Figure 1:
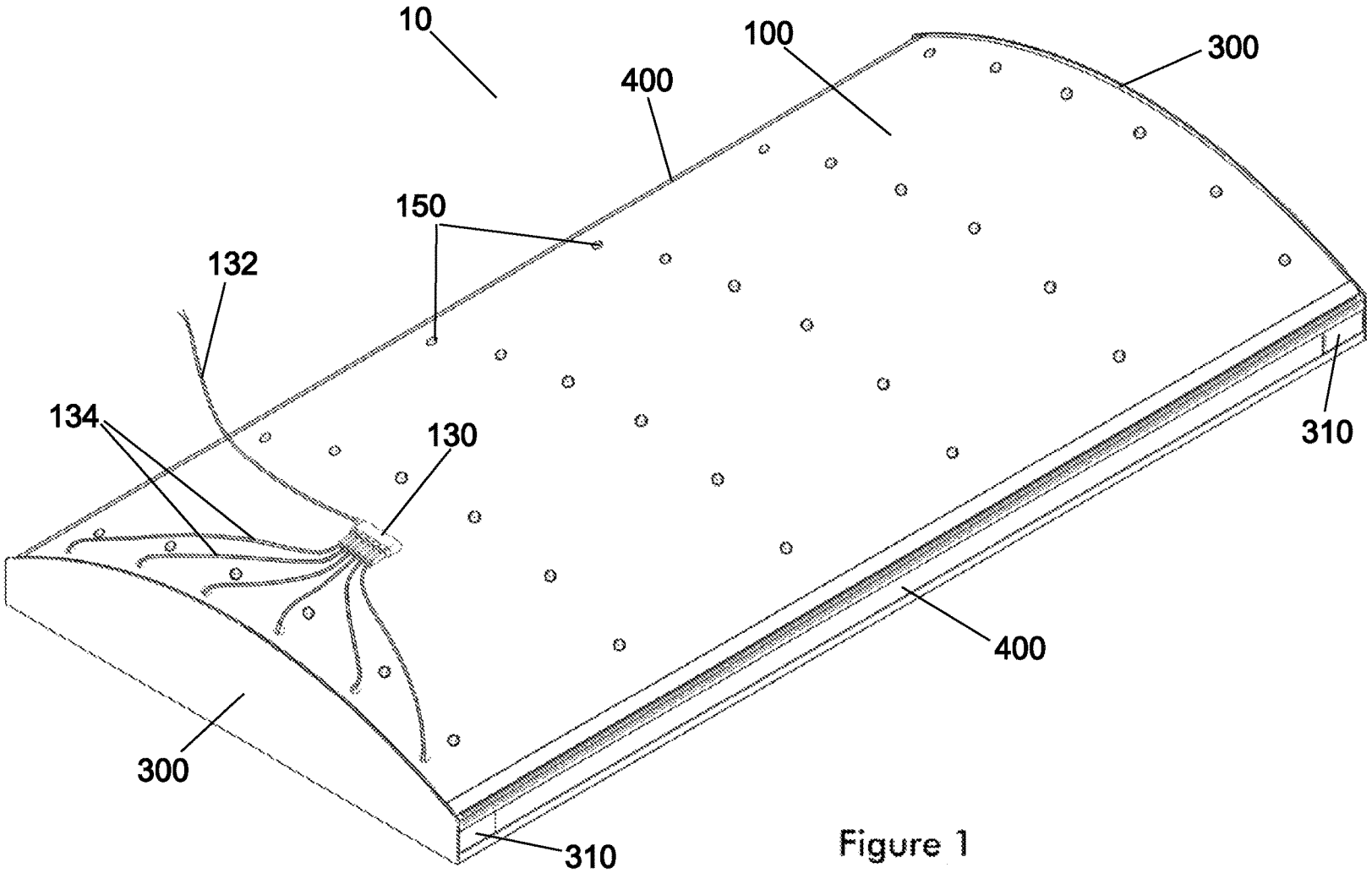
FIG. 1 shows a perspective assembled view of a LED lighting panel, according to an embodiment of the disclosed technology.

FIG. 1 shows a perspective assembled view of a LED lighting panel fixture, according to an embodiment of the disclosed technology. The fixture 10 is generally composed of a flexible upper LED panel 100 removably fixed between two end caps 300 and two side rails 400. The panel 100 has a plurality of strips or rows of individual LED bulbs 150. The bulbs 150 are oriented downwards from points along a concave surface of the panel 100. Alternatively, the bulbs 150 may be embedded within the panel 100 at least on one surface.

The fixture 10 has a wire terminal 130 that may be disposed on the upper panel 100. A power cable 132 extends from the terminal 130 to provide power to the fixture 10 from an external source. Individual wire leads 134 also extend from the terminal 130 to each of the strips or rows of LED 150.

Figure 2:
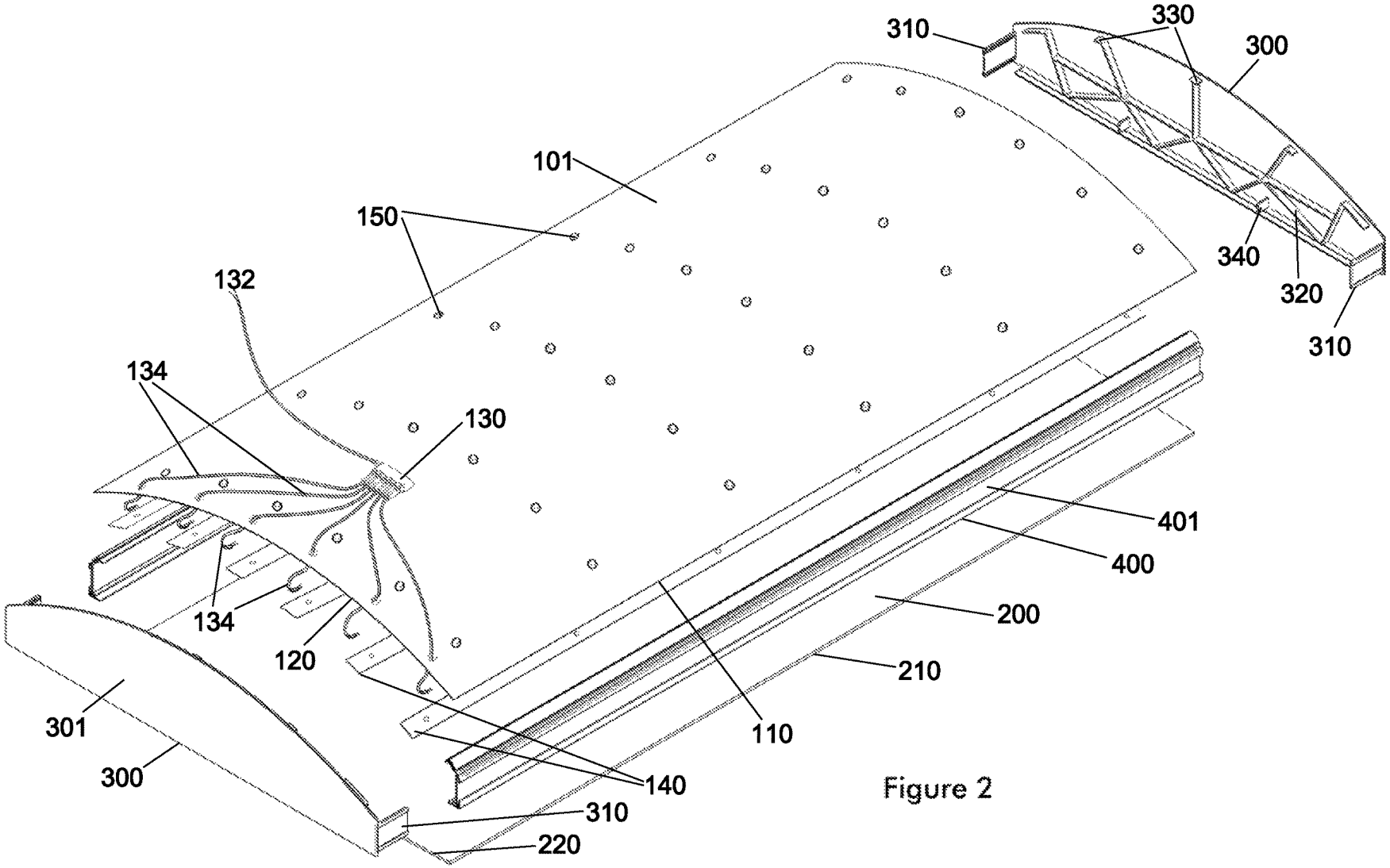
FIG. 2 shows an exploded view of a LED lighting panel according, to an embodiment of the disclosed technology.

FIG. 2 shows an exploded view of a LED lighting panel fixture, according to an embodiment of the disclosed technology. The LED strips 140 are depicted below the upper panel 100. The strips 140 may be conductive or may contain a conductor embedded therein. Leads 134 are shown extending from the terminal 130 to each individual LED strip 140 for powering each of the LED bulbs 150. Also depicted in FIG. 2 are the end caps 300 and side rails 400. Upon assembly and/or installation, the flexible panel 100 is deflected or bent slightly, and slid into receiving recesses in the end caps 300 and side rails 400. A lower panel 200 is formed of a transparent or translucent material, and is likewise slidably affixed between the end caps 300 and the side rails 400.

Referring back to FIG. 1, when the panel 100 is installed, it has a curvature which facilitates a greater coverage area of the light produced by the LED bulbs 150. The concave curvature of the panel 100 may be different, based on the width of the panel and the distance between the side rails 400. The angle of curvature may be greater than, or equal to, 90 degrees from end to end. Further, the angle of curvature shall be, at maximum, 150 degrees. In one embodiment, the curvature is 120 degrees from end to end. The curvature forms a curvilinear upper piece 100 when assembled between two rails 400, the rails held together by end caps. As such, screws or other fastening devices are not necessary, though they may be used. When the fixture 10 is unassembled, the LED panel 100 may be generally flat or planar. Thus, the entire fixture 10 may be stored and/or shipped in a flat package.

Referring still to FIG. 2, it should be noted that the LED lighting strips 140 connect to the terminal 130 via individual wires 134. The lighting strips 140 are shown below the upper panel 100 and, as they are attached to the bent light upper panel, each is disposed at a different angle. The individual strips 140 of LED lights 150 may be directional lights which are cheaper to produce, as each strip faces an angle different from that of another. Except for the middle strip in embodiments which points straight down (that is, in a direction straight towards the lower panel), each LED strip 140 may be at the same angle offset from the middle strip or from the middle/highest point of the upper panel 100. Each LED strip 140 shines light perpendicular to the upper panel 100. As each is facing a different angle, each one shines light in a different direction. The combination of lights 150 in different directions provides a blanketed lighting effect. Each LED strip 140 needs only to project light in a width as wide as the end of the next LED strip. So, for example, when installed in an 8 foot ceiling and blanketing an area between 0 foot and 5 feet off the ground, the LED strips 140 may be at 30 degree angles to one another. Thus, each must have a splash (lighting) radius of 30 degrees over three feet to meet the desired goal of blanketing a room with smooth and even light.

The lower panel 200 may be substantially transparent or translucent. The lower panel 200, like the upper panel 100, may be rectangular, having two longer edges 210 and two shorter edges 220. The lower panel 200 is cradled and secured by the end caps 300 and the side rails 400. Specifically, the longer edge 210 of the lower panel 200 is inserted into a longitudinal, horizontal slot 420 near the bottom edge 403 of the side rail 400. Further, the shorter edges 220 of the lower panel 200 are inserted between a tab 340 and a lower rail 345 of the end cap 300. Thus, the four edges of the lower panel 200 are secured and fixed in place. The end caps 300 and the side rails 400 also connect to one another to form an outer frame. Flanges 310 are extended orthogonally from the ends of the end cap 300. The flanges 310 can be inserted into corresponding upper and lower side slots 431, 432 extending along an outwardly facing surface 401 of the side rail 400. The flanges 310 fit snuggly into the slots 431, 432, and may 'click' into place.

Figure 3:
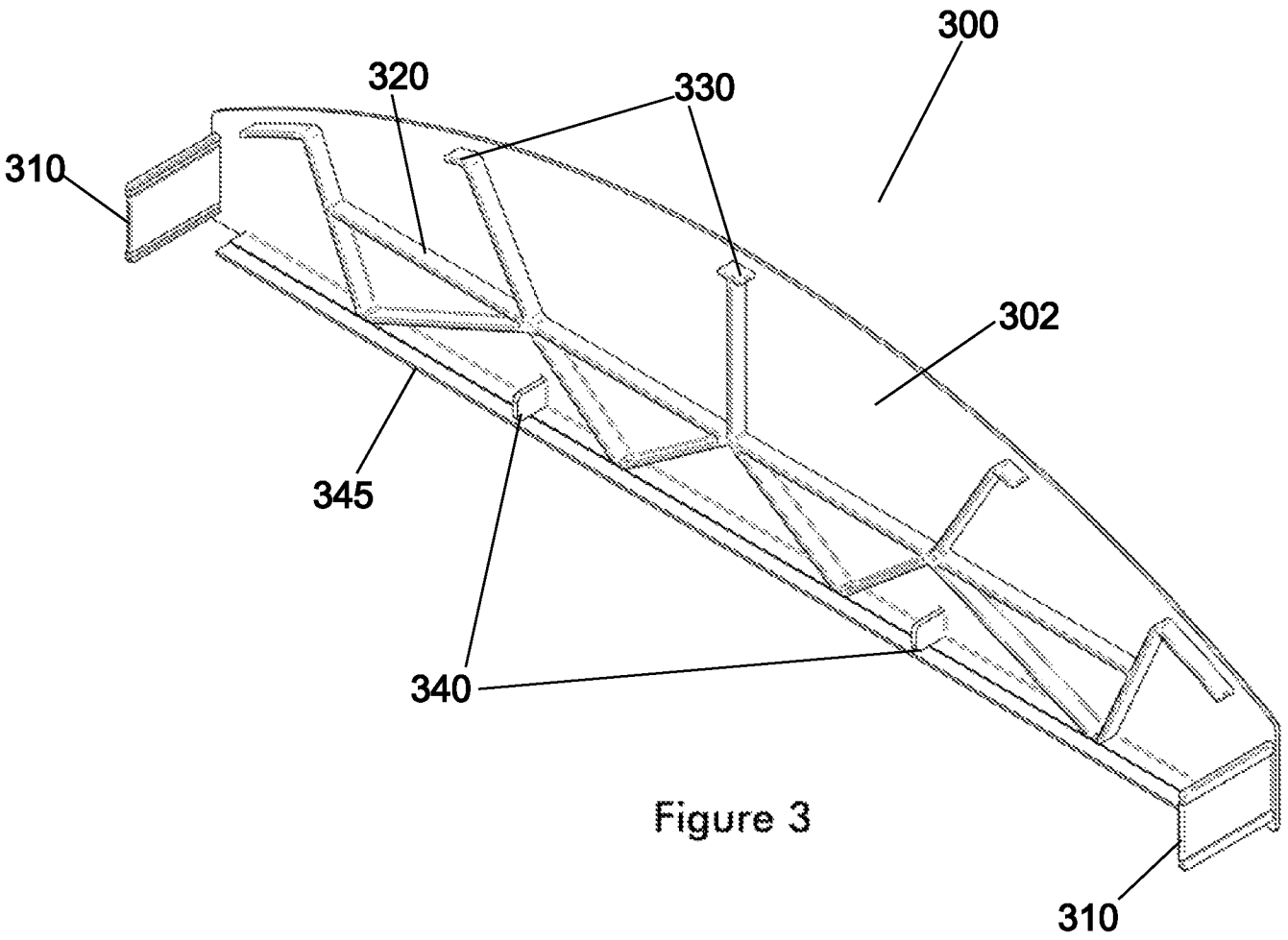
FIG. 3 shows a perspective view of an end cap, according to an embodiment of the disclosed technology.

FIG. 3 shows a perspective view of an end cap, according to an embodiment of the disclosed technology. The end cap 300 has two male connectors or flanges 310, one disposed at either end of the end cap. The flanges 310 are horizontally arranged to be inserted into the ends of the side rails 400. The end cap 300 has a skeletal truss frame 320 for providing support of the panels 100, 200 and/or the entire fixture 10. End supports 330 of the truss members 320 provide contouring onto which the panel 100 is abutted. An additional slot may be defined between tabs 340 and a lower edge 345, along a straight portion of the end cap for receiving the shorter edge 210 of the lower panel 200 of the lighting fixture 10 therein.

Figure 4:
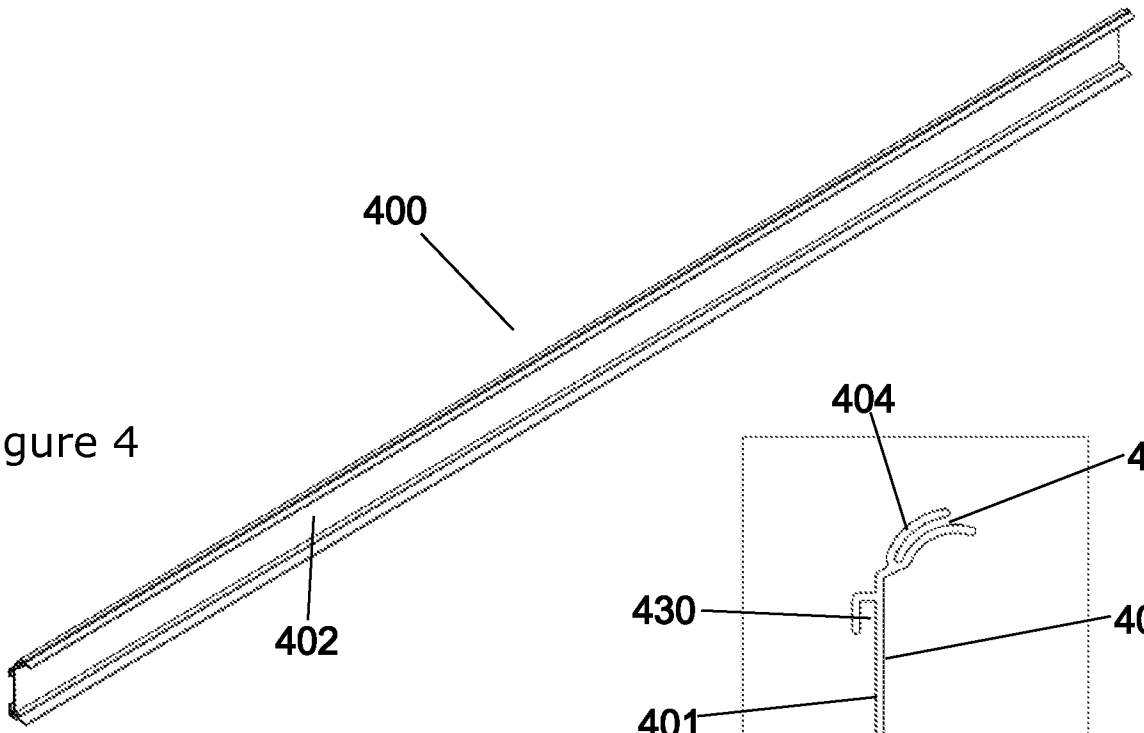
FIG. 4 shows a perspective view of a side rail according to an embodiment of the disclosed technology.
Figure 5:
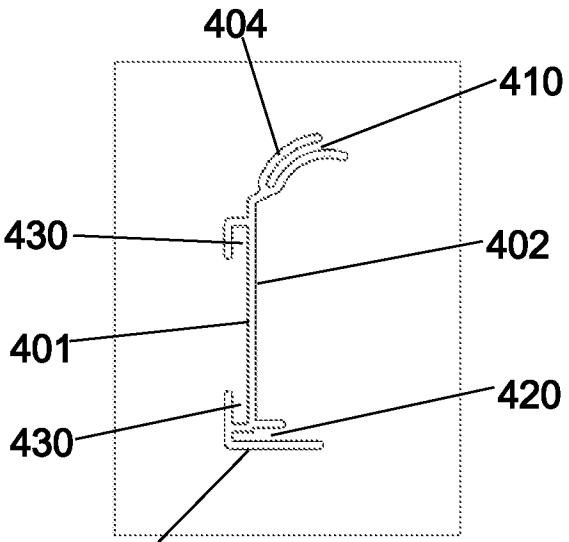
FIG. 5 shows a cross-sectional view of the side rail of FIG. 4, according to an embodiment of the disclosed technology.

FIG. 4 shows a perspective view of a side rail, according to an embodiment of the disclosed technology. FIG. 5 shows a cross-sectional view of the side rail of FIG. 4, according to an embodiment of the disclosed technology. The side rail has three slots 410, 420, 430 for receiving portions of the fixture. A bottom slot 420 is generally horizontally disposed for receiving an edge 210 of the lower panel 200 therein. A vertical slot 430 extends along an outer edge 401 of the side rail 400. The vertical slot 430 receives the flange 310 on the end cap 300. The two side rails 400 and two end caps 300 form a four-sided, rectangular frame for supporting the LED panel 100. The curved upper slot 410 receives and holds the longer edge 110 of the upper panel 100 in a curved arrangement. An inwardly facing side surface 402 of the side rail 400 is concealed when the fixture 10 is assembled. A lower surface 403 of the side rail 400 is visible when the fixture 10 is installed in a typically drop ceiling arrangement.

Figure 6:
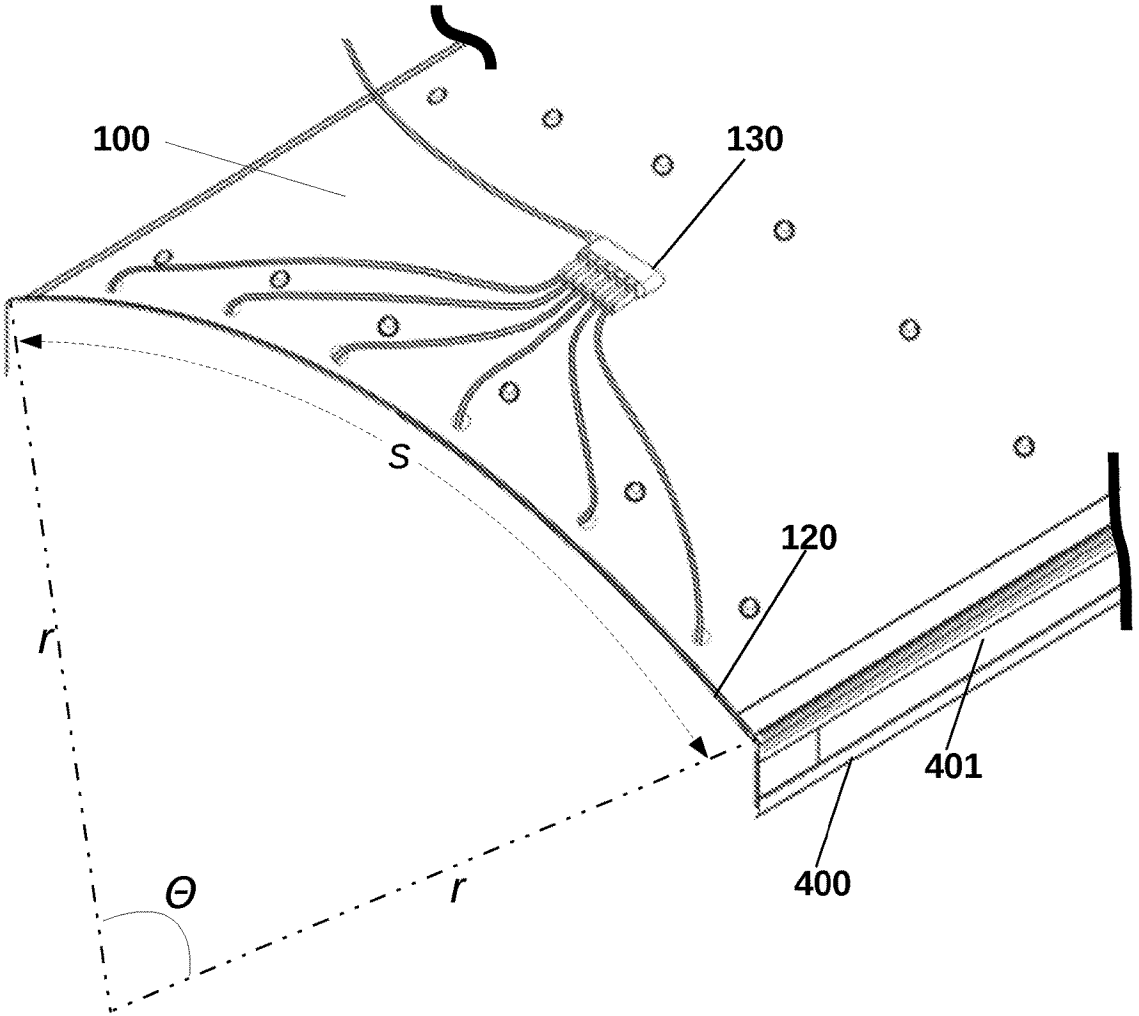
FIG. 6 shows a partial cut-away view of the upper panel and side rails, according to an embodiment of the disclosed technology.
Figure 7:
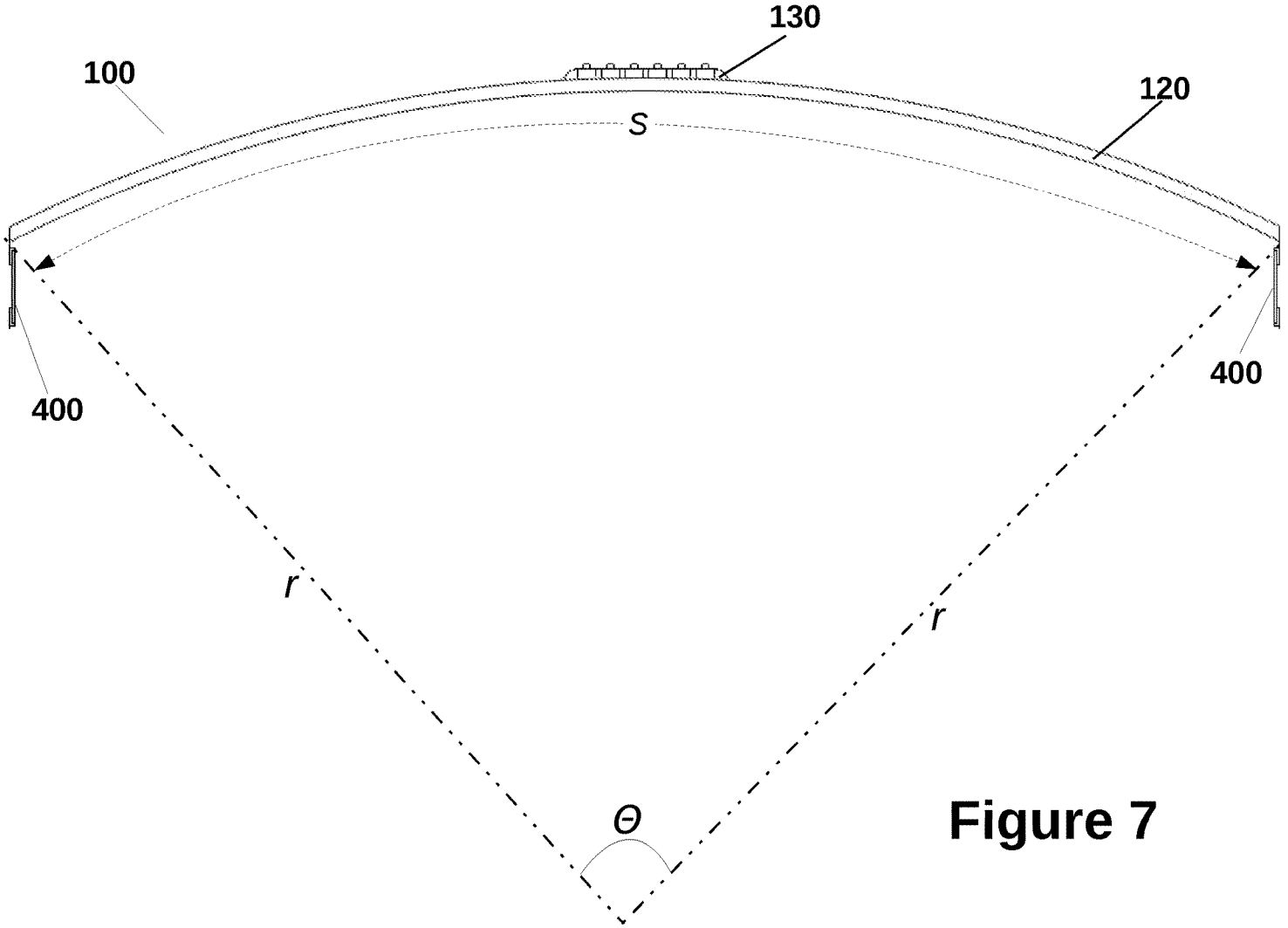
FIG. 7 shows a cross-sectional view of the upper panel and side rails, according to an embodiment of the disclosed technology.

FIG. 6 shows a partial cut-away view of the upper panel and side rails, according to an embodiment of the disclosed technology. FIG. 7 shows a cross-sectional view of the upper panel and side rails, according to an embodiment of the disclosed technology. Upon installation or assembly of the light fixture 10, the upper panel 100 will be flexibly bent or curved. The curved panel forms an arc, having a given arc length, s, and a radius of curvature, r. Thus, the angle of curvature of the arc, in radians, is defined by a formula:

$$\Theta = \left(\frac{s}{r}\right) \qquad \text{Eq. 1}$$

Converting radians to degrees, the angle of curvature of the arc is defined by the following equation:

$$\Theta = \left(\frac{s}{r}\right)\left(\frac{180}{\pi}\right) \qquad \text{Eq. 2}$$

In an embodiment of the disclosed technology, the angle of curvature, in degrees, may be approximately 60. This angle yields a large light coverage area based on the different angles at which the LEDs are facing. The angle of curvature may vary in a range from 30 degrees to 120 degrees, depending on the application. The radius of curvature may be around 25 inches for standard-sized embodiment of the fixture 10. This yields an arc length, s, of approximately 24.5 inches. However, different-sized fixtures may have different radii of curvature, but, the angle of curvature shall stay consistent, whether it be 45 degrees, 60 degrees, 90 degrees, etc.

Figure 8:
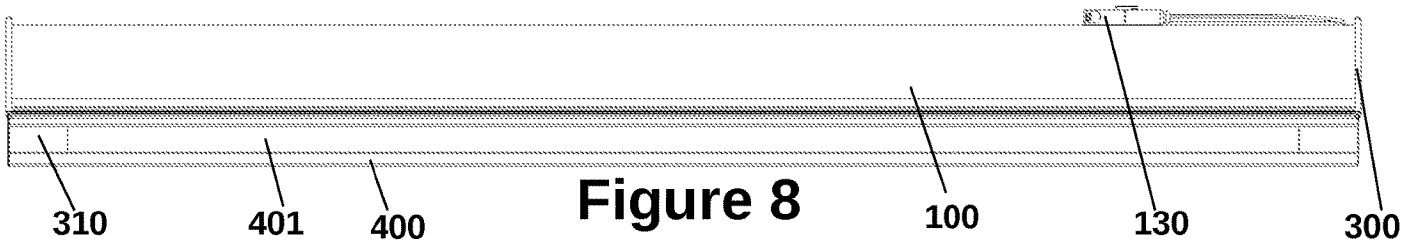
FIG. 8 shows a side elevation view of a LED lighting panel fixture, according to an embodiment of the disclosed technology.

FIG. 8 shows a side elevation view of a LED lighting panel fixture, according to an embodiment of the disclosed technology.

Figure 9:
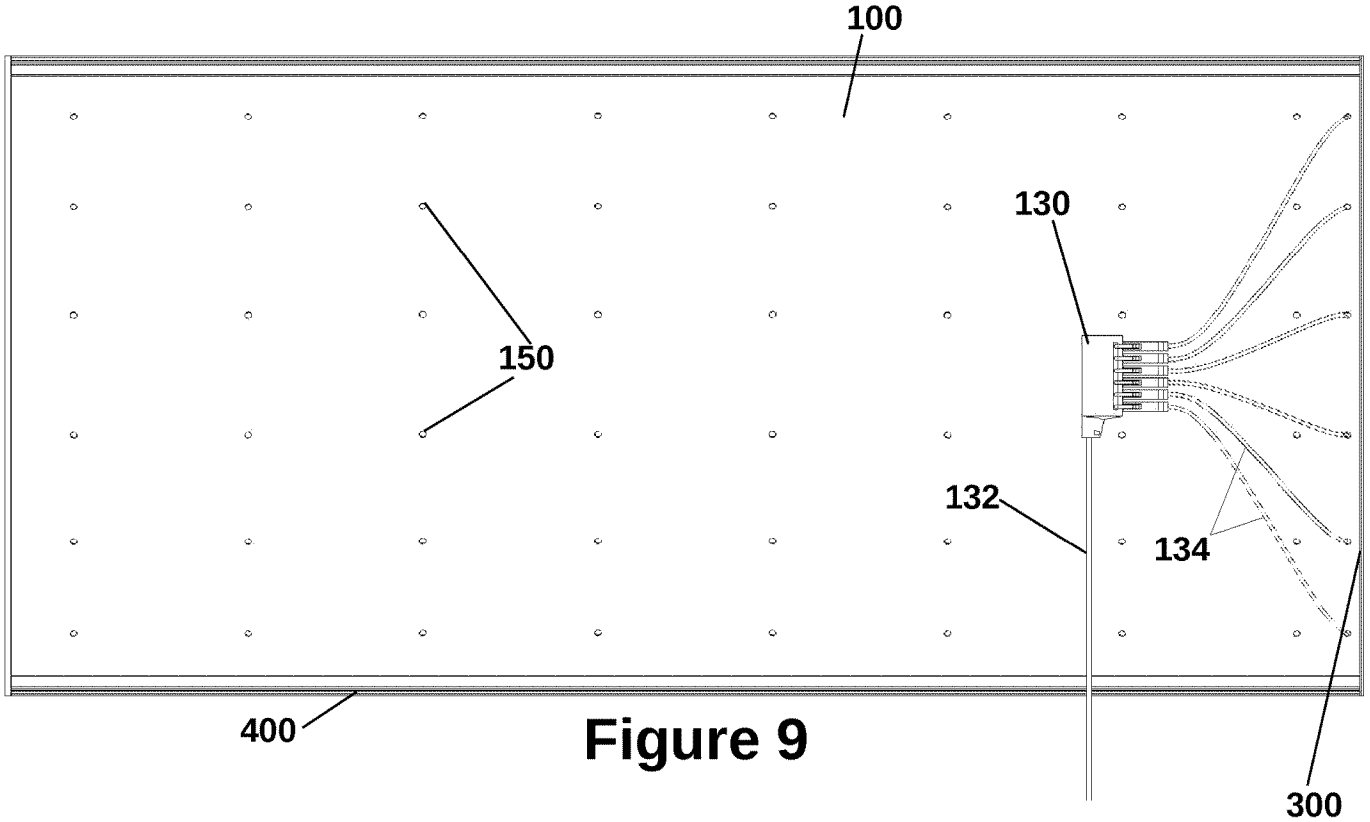
FIG. 9 shows a top plan view of a LED lighting panel fixture, according to an embodiment of the disclosed technology.

FIG. 9 shows a top plan view of a LED lighting panel fixture, according to an embodiment of the disclosed technology. The fixture 10 generally has a rectangular footprint. Thus, the upper panel 100, due to its curvature when assembled, may be slightly wider than the lower panel 200. The exterior surface 401 of the side rail 400 is visible when the fixture is viewed from the side. However, if the fixture is installed in a drop ceiling or any other recessed lighting arrangement, these portions would not be visible. The flanges 310 reside within the longitudinal slot 430 of the side rail 400, a portion of which is exposed. The end caps 300 reside at the extremities of the fixture 10.

Figure 10:
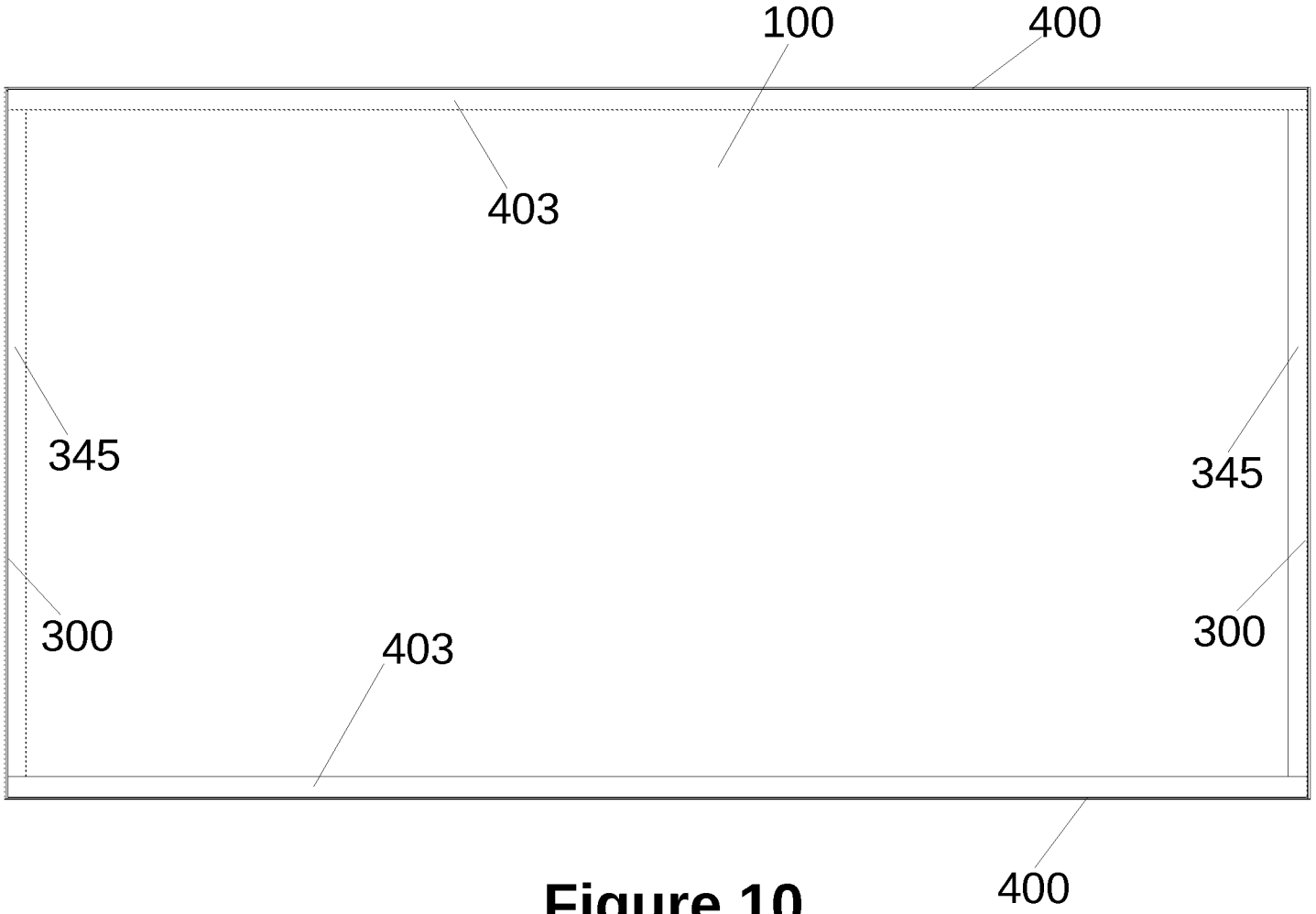
FIG. 10 shows a bottom plan view of a LED lighting panel fixture, according to an embodiment of the disclosed technology.

FIG. 10 shows a bottom plan view of a LED lighting panel fixture, according to an embodiment of the disclosed technology. The portion of the fixture 10 depicted in FIG. 10 is the portion that is visible when the fixture is installed in a building. The lower panel 200 is generally flat, and transparent or translucent. In the embodiment shown, the lower panel 200 is translucent, thereby only allowing light to pass through, while the inside region of the fixture 10 is not visible. The bottom edge 345 of the end cap 300 is exposed when the fixture is installed. Further, the bottom edge 403 of the side rail 400 is also exposed. The two edges 245 and 403 may have a similar appearance, such that the outer frame of the fixture appears uniform.

Figure 11:
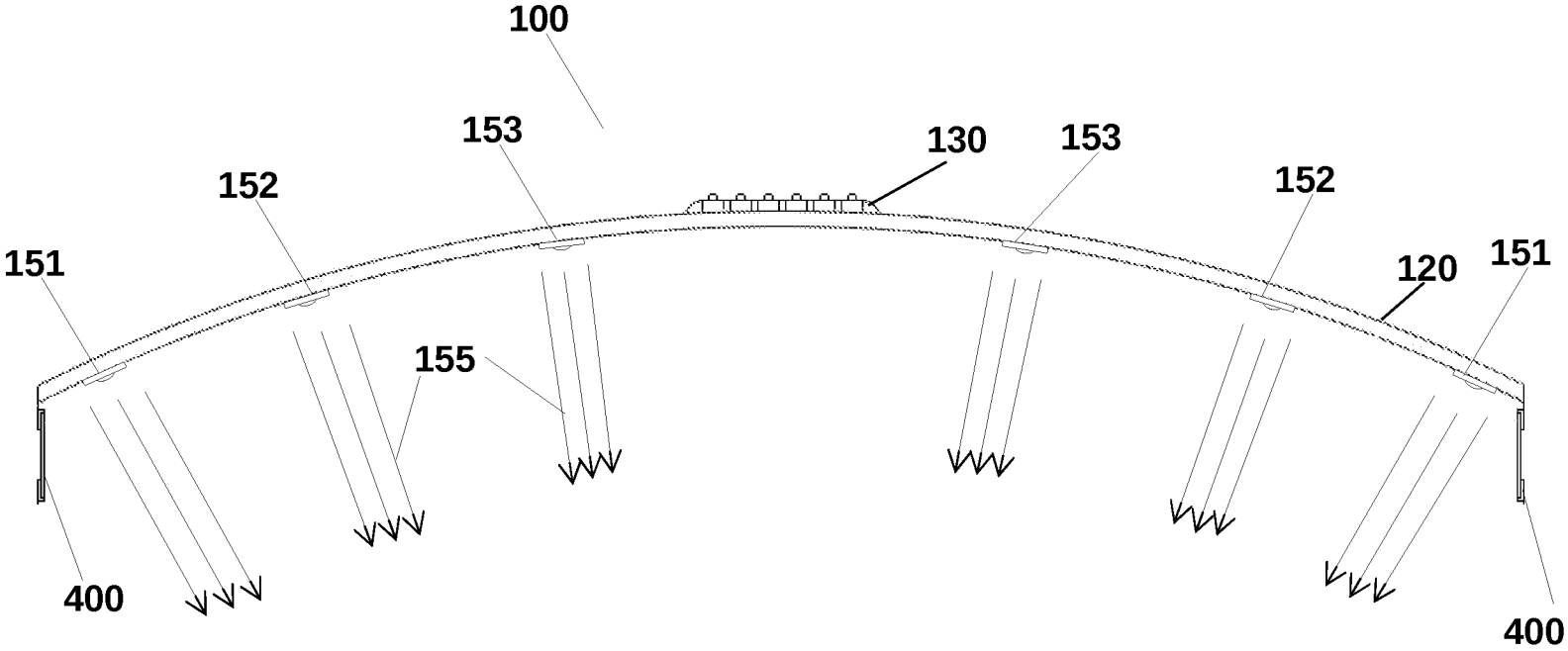
FIG. 11 shows LEDs arranged on the concave surface of the upper panel, according to an embodiment of the disclosed technology.

FIG. 11 shows light-emitting diodes arranged on the concave surface of the upper panel, according to an embodiment of the disclosed technology. In the embodiment shown, six strips of LEDs are disposed longitudinally along the concave surface of the upper panel 100. The outermost strip of LEDs 151 is disposed at the most inclined angle of the strips of LEDs. Thus, the light rays 155 projected from these outermost LEDs 151 are oriented at an angle to project light to regions that are not just below the fixture 10, but to the sides of the fixture. The innermost LEDs 153 project light rays 155 substantially downwards from the fixture 10. Thus, these rays 155 are projected substantially vertically. The middle LEDs 152 project light at an intermediary angle between the outermost LEDs 151 and the innermost LEDS 153. The combination of LEDs provides the most efficient lighting arrangement with the greatest amount of light coverage. Because the light is projected horizontally as well as vertically, less power and fewer fixtures are needed to properly illuminate a space or room.

Figure 12:
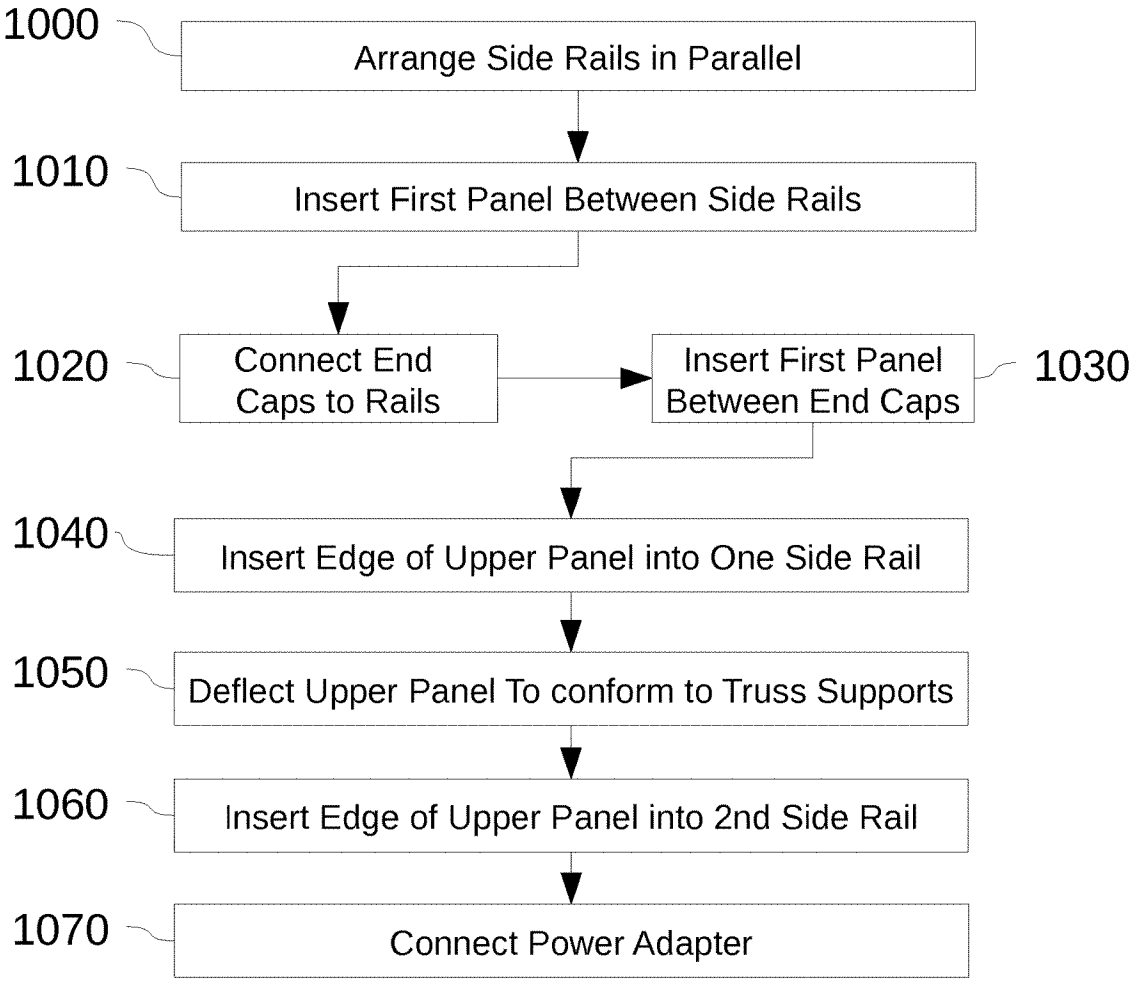
FIG. 12 shows a flow chart depicting steps taken in a method of carrying out the disclosed technology.

FIG. 12 shows a flow chart depicting steps taken in a method of carrying out the disclosed technology. The method involves assembling the fixture 10 described in FIGS. 1 through 11, according to the disclosed technology. The parts of the fixture 10 may be enclosable within a container when sold or transported. The upper panel 100 may be generally flattened when the fixture 10 is not in its assembled form. The other parts, including the side rails 400, the end caps 300, and the lower panel 200, are generally thin and do not occupy a large volume. Thus, all of the components of the fixture 10, prior to assembly, may be strategically packaged in a thin, elongated package, which may have a thickness of approximately two inches.

The method begins with step 1000, whereby the side rails may be arranged in parallel on a surface. Next, in step 1010, the side rails are slid onto the lower panel along the longer edges of the lower panel. Alternatively, the first step may involve performing the same action with the end caps and the shorter edges of the lower panel. The next two steps, 1020 and 1030, are shown depicted in parallel as they may be performed. Step 1020 involves connecting the end caps to the side rails. Then, in step 1030, the first panel is inserted between the end caps.

Once the end caps are connected to the side rails, a frame structure is formed which is a stable structure. Provided that the LED strips or lights are already in place on the surface of the upper panel, the upper panel may be installed onto the frame. Thus, in step 1040, a longer edge of the upper panel is inserted into the corresponding slot on one of the side rails. Once the edge is in place, in step 1050, the upper panel may be deflected or folded over, such that the concave surface of the upper panel abuts the truss supports on the side rails. As the upper panel is deflected to abut the truss supports, in step 1060 the other edge of the upper panel may be inserted into the corresponding slot on the other side rail. At this point the fixture is substantially assembled, and in step 1070 the fixture may be connected to a power source.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described hereinabove are also contemplated and within the scope of the invention.

The invention claimed is:

1. A light fixture comprising:

a substantially flat planar panel deformed into a curvilinear upper panel by way of two opposing side rails held in place by two opposing end caps;

said curvilinear upper panel with two long edges and two short edges;

a substantially flat planar and translucent lower panel having two long edges and two short edges;

said two opposing end caps, each end of said end cap having two flanges which are disposed at an end thereof the respective said end cap in a manner such that said flanges extend orthogonally along an elongated length of said respective end cap in a single plane; and said two opposing side rails, having a first elongated length with three distinct slots extending therefrom, said three distinct slots being:

a curved upper slot frictionally engaged to said substantially flat planar panel and causing said deforming of said curvilinear upper panel;

a bottom slot extending perpendicularly from said elongated length of each said two opposing side rails; and a vertical slot formed between two flanges extending towards each other and parallel to said first elongated length which emanate from an outer edge of said first elongated length of said side rail horizontally for receiving said flanges of said two opposing end caps.

2. The light fixture of claim 1, having a plurality of LED lights disposed on an inner surface thereof.

3. The light fixture of claim 1, wherein each of said two opposing end caps has supports abutting said curvilinear upper panel.

4. A method of assembling a light fixture, comprising:

arranging two opposing side rails parallel to one another each having vertical slots formed between two flanges extending towards each other and parallel to a first elongated length of said side rail which emanate from an outer edge of said first elongated length of said side rail horizontally for receiving flanges of two opposing end caps;

inserting a flat longitudinal panel between said two opposing side rails;

inserting a second flat longitudinal panel between said two opposing side rails, wherein said second longitudinal panel has a substantially equal length of said first longitudinal panel and a longer width than said first longitudinal panel; and inserting said flanges of said two opposing end caps into said vertical slots of said side rails, such that said first flat longitudinal panel remains flat between said side rails, and said second flat longitudinal panel becomes curved with a concave side thereof facing towards said first longitudinal panel;

inserting shorter edges of said first longitudinal panel into corresponding horizontals of said side rails, such that each of said end caps adorns substantially an entire length of each shorter edge of said first longitudinal panel;

deflecting said second longitudinal panel to an angle of curvature between 90 degrees and 180 degrees, and inserting longer edges of said upper panel into curvilinear upper slots of said side rails, such that said upper panel becomes fixed in a deflected position.

5. The method of claim 4, further comprising a step of:

attaching a power source to LED in strips to the concave side of said first longitudinal panel.

6. The method of claim 5, wherein each of said two opposing side rails has a horizontal bottom slot with an edge of said first longitudinal panel engaged therein and said method further comprises a step of:

inserting longer edges of said first longitudinal panel into said horizontal bottom slots, such that each of said side rails adorns substantially an entire length of each longer edge of said first longitudinal panel.

* * * * *